US005935477A

United States Patent [19]

Koochaki

[11] Patent Number: 5,935,477

[45] Date of Patent: Aug. 10, 1999

[54] CONTINUOUS MICROWAVE COOKING GRILL HAVING A PLURALITY OF SPACED SEGMENTS

[75] Inventor: Kamel K. Koochaki, Warren County, Ohio

[73] Assignee: Kontract Product Supply Inc., Loveland, Ohio

[21] Appl. No.: 08/681,184

[22] Filed: Jul. 22, 1996

[51] Int. Cl.[6] ..... H05B 6/80

[52] U.S. Cl. ..... 219/725; 219/728; 219/730; 219/759; 219/745; 426/107; 426/243; 99/DIG. 14

[58] Field of Search ..... 219/728, 730, 219/759, 732, 733, 734, 735, 763, 725, 745; 426/107, 109, 234, 241; 99/DIG. 14

[56] References Cited

U.S. PATENT DOCUMENTS

| | | | |
|---|---|---|---|
| 3,271,552 | 9/1966 | Krajewski . | |
| 3,591,751 | 7/1971 | Goltsos et al. . | |
| 3,835,280 | 9/1974 | Gades et al. | 219/728 |
| 3,845,266 | 10/1974 | Derby . | |
| 3,941,968 | 3/1976 | MacMaster et al. | 219/728 |
| 3,946,187 | 3/1976 | MacMaster et al. . | |
| 4,230,924 | 10/1980 | Brastad et al. . | |
| 4,320,274 | 3/1982 | Dehn . | |
| 4,369,346 | 1/1983 | Hart et al. | 219/730 |
| 4,542,271 | 9/1985 | Tanonis et al. . | |
| 4,728,762 | 3/1988 | Roth et al. . | |
| 4,825,025 | 4/1989 | Seiferth . | |
| 4,865,921 | 9/1989 | Hollenberg et al. . | |
| 4,866,234 | 9/1989 | Keefer . | |
| 4,883,936 | 11/1989 | Maynard et al. . | |
| 4,888,459 | 12/1989 | Keefer . | |
| 4,934,829 | 6/1990 | Wendt . | |
| 4,952,764 | 8/1990 | Harrington . | |
| 4,992,636 | 2/1991 | Namiki et al. . | |
| 5,004,882 | 4/1991 | Nottingham et al. . | |
| 5,057,659 | 10/1991 | Schneider et al. . | |
| 5,107,087 | 4/1992 | Yamada et al. . | |
| 5,144,106 | 9/1992 | Kearns et al. . | |
| 5,151,568 | 9/1992 | Rippley . | |
| 5,154,114 | 10/1992 | Chang . | |
| 5,223,685 | 6/1993 | DeRienzo, Jr. . | |
| 5,254,820 | 10/1993 | Pesheck et al. . | |
| 5,280,150 | 1/1994 | Arai et al. . | |
| 5,310,980 | 5/1994 | Beckett | 219/728 |
| 5,322,984 | 6/1994 | Habeger, Jr. et al. . | |
| 5,354,973 | 10/1994 | Beckett . | |
| 5,396,052 | 3/1995 | Petcavich et al. . | |
| 5,397,879 | 3/1995 | Geissler . | |
| 5,484,765 | 1/1996 | Dionne et al. . | |
| 5,493,103 | 2/1996 | Kuhn . | |
| 5,558,798 | 9/1996 | Tsai . | |
| 5,698,127 | 12/1997 | Lai et al. | 219/730 |

FOREIGN PATENT DOCUMENTS

| | | | |
|---|---|---|---|
| 56-42022 | 4/1981 | Japan | 219/730 |
| 63-302222 | 12/1988 | Japan | 219/730 |
| 4-143520 | 5/1992 | Japan | 219/730 |

*Primary Examiner*—Philip H. Leung
*Attorney, Agent, or Firm*—Dinsmore & Shohl LLP

[57] ABSTRACT

A microwave grilling apparatus comprising a continuous conductive grill element which is a continuous element shaped into a plurality of elements segments. At least a portion of the cross-sectional area of the elements segments of the continuous grill element has a surface area between about $5\times10^{-3}$ cm$^2$ to about 0.1 cm$^2$. Additionally, a microwave grilling apparatus comprising multiple continuous grill elements and at least one tray is provided. The grill elements can be rectangular, round or other geometric configurations and are used for grilling comestibles in a microwave oven.

32 Claims, 4 Drawing Sheets

CONTINUOUS MICROWAVE COOKING GRILL HAVING A PLURALITY OF SPACED SEGMENTS

FIELD OF THE INVENTION

The present invention relates to a grilling apparatus for use in a microwave oven and more particularly a continuous conductive grill element which is designed to grill food products in a microwave oven without substantial arcing and/or overheating. The continuous grill elements of the present invention can be used alone or in combination with other grill elements of the present invention to simultaneously grill and cook food through conventional microwave cooking.

BACKGROUND OF THE INVENTION

Microwave ovens have become increasingly popular in recent years due in large part to the speed with which a conventional microwave oven can cook certain foods. Microwave ovens produce high frequency, electromagnetic energy fields which cause certain molecules to oscillate at a greater rate thereby producing heat. For example, a water molecule has a di-pole which absorbs microwave energy and indirectly converts that microwave energy to thermal energy. The heat produced by the interaction of microwave energy and water molecules is generally not greater than about 100° C. because the water evaporates at that point. Many food substances comprise sufficient quantities of water, or other microwave absorbing materials, to make them susceptible to microwave cooking.

In a conventional oven, electricity, gas, wood, etc. is converted to thermal energy. The thermal energy is transmitted to the air within the oven, the oven walls, the oven racks, the food being cooked and the container the food is being cooked in. Additionally, conventional ovens operate by heating the outside of the food being cooked and wherein the interior portion of the food being cooked is heated by the conduction of thermal energy from the exterior surface of the food to the interior. Cooking food from the exterior surface inward is both slow and inefficient because, as mentioned briefly above, the entire interior of the oven and all the contents of the oven must be heated. However, conventional ovens, while slow and generally energy inefficient, have one perceived advantage over conventional microwave ovens. Because the thermal energy envelopes the exterior of the food being cooked it is often possible to "brown" and/or "crisp" the exterior of the food product. It has heretofore been difficult to brown or crisp food in a conventional microwave oven.

Microwave ovens, which typically operate at 2450 MHz, supply microwave energy which is absorbed by the "lossy" component of foods. A lossy component is any portion of food, or other product, which absorbs microwave energy and converts at least a portion of that microwave energy to thermal energy. Microwave ovens are typically designed so that the microwave energy is not absorbed by the interior surfaces of the microwave. Thus, microwave energy does not generally heat the interior surfaces of the microwave oven. While the microwave cooking process is energy efficient, the exterior of the food product is typically cooked at the same rate as the interior of the food. Thus, browning and/or crisping of the food's exterior generally does not occur in a microwave oven.

There have been many attempts to rectify this shortcoming of microwave ovens, i.e., to brown and/or crisp food while cooking it in a microwave oven. For example, U.S. Pat. No. 5,493,103, which issued on Feb. 20, 1996 to Kuhn, discloses a baking utensil which essentially surrounds the food being cooked with a layer of material containing ferrite particles. The ferrite particles absorb microwave energy, and convert it to thermal energy until the Curie temperature of the ferrite is reached. The Curie temperature is a characteristic of the ferrite and different particles can be selected depending upon their Curie temperatures and the desired cooking results. When the Curie temperature is reached the particulate ferrite layer reflects excess microwave energy away from the food.

The process described by Kuhn is inherently inefficient in that some of the microwave energy is reflected away from the food. Moreover, because the food is completely surrounded by a particulate ferrite layer, the microwave energy is not transmitted directly to the food but must generally be converted to thermal energy. The conversion of microwave energy to thermal energy essentially eliminates the benefits of microwave cooking, i.e., the speed associated with the direct absorption of microwave energy by molecules in the food being cooked. Thus, while it may be possible to shield food from microwave energy and convert the microwave energy to thermal energy, this process essentially converts the microwave oven to an inefficient conventional thermal conduction oven.

U.S. Pat. No. 5,396,052, which issued on Mar. 7, 1995 to Betcavich, et al. discloses a cooking pot having a lid wherein the base material of the pot and lid is essentially transparent to microwave energy. The interior of the cooking pot is glazed with a microwave absorbing material. The food inside of the pot is cooked by normal thermal conduction as the interior glaze both converts microwave energy to thermal energy and reflects excess microwave energy away from the food inside of the container. While this configuration may provide the desired browning and/or crisping on the exterior of the food, it does not retain the speed and energy efficiency of a conventional microwave oven.

As an alternative to completely encasing food in a microwave absorbing material, a suceptor layer, or layers, of microwave absorbing material have been used in an attempt to brown at least a portion of the exterior of food placed on the suceptor layer. In general, any material that converts microwave energy to thermal energy is considered a "susceptor". However, the term susceptor is often used to refer to a layer of microwave absorbing material. For example, U.S. Pat. No. 4,542,274, which issued on Sep. 17, 1985 to Tanonis, et al. describes a microwave cooking pan, for example a pie pan, wherein a layer of plastic with magnetic particles disbursed evenly throughout is used as a heating layer. The heating layer converts microwave energy to thermal energy thereby browning at least a portion of one surface of the food placed thereupon.

Additionally, U.S. Pat. No. 5,144,106, which issued on Sep. 1, 1992 to Kearns, et al. uses a layer of cooking oil or fat as a susceptor. The oil or fat is separated from the food being cooked by a material which can conduct heat from the oil or fat to the food. The fat or oil absorbs microwave energy, converts it thermal energy which is conducted to the layer of material between the food and the oil. Thus, a surface is provided where the food can be cooked both by thermal conduction and microwave absorption. The fat or oil produces a temperature in excess of 100° C. on which to cook the food because fats and oils typically boil at a much higher temperature. A typical microwave oven can heat cooking oil or fat to a temperature of from about 125° C. to 225° C.

The references discussed above utilize flat, essentially continuous layers of material which absorb microwave energy, reflect microwave energy or both. Flat continuous sheets of susceptor material were generally preferred in the past to avoid the problem of "arcing" and/or localized overheating of the conductive element. Arcing, and localized overheating can burn food in the microwave oven, damage the microwave oven itself, and in extreme cases cause fires to start within the microwave oven. For example, a small pin hole in a metallic layer can cause arcing across the hole which results in sparks and/or damage to the metallic layer. Decorative utensil handles, for example forks, spoons and the like, often "arc" due to the multiple edges, layers and non-uniformities in the metallic structure. Likewise, the ends of exposed elements, for example the rods disclosed in U.S. Pat. No. 3,591,751 which issued Jul. 6, 1971 to Goltsos, can arc and/or overheat near the tips of the rods.

Attempts have been made to design suceptors which are not flat and continuous sheets of microwave absorbing material. For example, U.S. Pat. No. 5,322,984, which issued on Jun. 21, 1994 to Habeger, Jr. et al., shows a series of "antenna" elements which are used to collect microwave energy, convert it to thermal energy and transmit the thermal energy to the grill element which is in contact with the food being cooked. It has been observed that antenna configurations similar to those disclosed in the patent to Habeger Jr. et al. can cause localized areas of overheating near the antenna ends, and arcing can also occur. Additionally, the antenna configuration also requires that a substantial portion of the element be placed away from the food which results in a significant amount of heat being generated at the antennas which is not directly transmitted to the food.

Thus, there has been a continuing need for an efficient microwave grill apparatus which can convert microwave energy to thermal energy to brown and/or crisp the exterior surface of a food product. Moreover, there exists a need for a microwave grilling apparatus which can grill food while at the same time avoiding arcing and/or localized areas of overheating in the apparatus. Additionally, there is a need for a microwave grilling apparatus which maintains the benefits of microwave cooking, i.e., speed and energy efficiency, while adding the desired browning and/or crisping function which has generally been lacking in conventional microwave cooking apparatuses.

SUMMARY OF THE INVENTION

It is an object of the present invention to obviate the problems associated with conventional microwave cooking ovens discussed above. It is an additional object of the present invention to provide a microwave grilling apparatus which combines the benefits of microwave cooking with the browning and crisping function normally found only in thermal conduction ovens, outdoor grills and the like.

These and additional objects are provided by the present invention. Specifically, the invention, in one embodiment, is directed to a microwave grilling apparatus which comprises a grill having a continuous conductive grill element. At least a portion of the conductive material of the continuous grill element preferably has a cross-sectional surface area of between about $5\times10^{-3}$ $cm^2$ to about 0.1 $cm^2$. In one preferred embodiment of the present invention the continuous grill element is arranged in a plurality of spaced apart element segments. In one especially preferred embodiment of the present invention the element segments are substantially parallel to one another.

In another preferred embodiment of the present invention, the invention is directed to a microwave grilling apparatus which comprises a grill having a continuous conductive grill element which is at least partially supported by a tray. The tray has a floor and at least one wall which interact to contain or absorb liquids. In an even more preferred embodiment a cover and a second continuous grill element are provided. The tray and grill element can be combined with the cover and grill element to grill a comestible, i.e., a food product, placed between the two grills.

In yet another preferred embodiment of the present invention a microwave grill is provided which comprises a continuous conductive grill element comprising a plurality of petal shaped elements spaced about, and projecting from, a round grill center. The petal shaped elements have a base portion wherein the base of the petal-shaped elements are spaced apart from one another by a predetermined distance. The purpose of using the petal-shaped segments of the continuous grill element is to create a generally continuous round grill element which has an essentially round outer periphery. The continuous grill elements, and microwave grilling apparatuses described herein combine the desired benefits of the browning and crisping function normally associated only with thermal conductive heating elements, with the speed of cooking associated with a microwave oven. The continuous grill elements of the present invention are designed to absorb microwave energy while minimizing arcing and minimizing the amount of microwave energy reflected away from the comestible. The continuous grill elements of the present invention provide these and other advantages while being light weight, relatively inexpensive, easy to manufacture and consuming only a small amount of space in the microwave oven.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
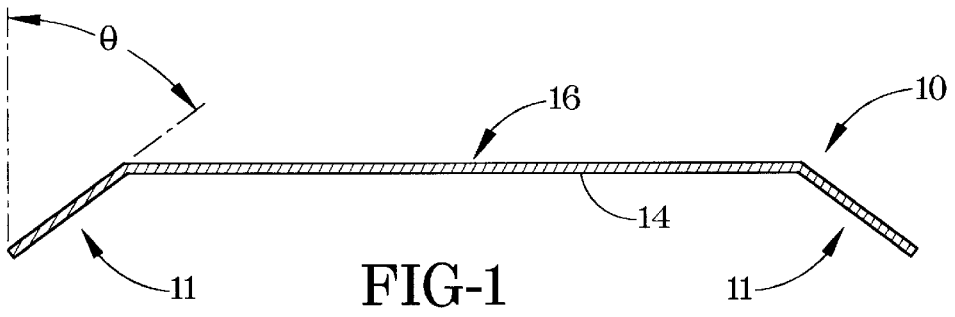
FIG. 1 is a schematic side view of a grill of the present invention comprising an angled continuous grill element.

Referring now to the drawings in detail wherein like numerals indicate the same elements throughout the views, FIG. 1 is a schematic side view of an angled grill 16 comprising grill element 14 wherein the grill element ends 11 have been bent to an angle θ. θ is preferable between about 20° and about 70° and more preferably between about 30° and about 50°. As will be understood, conventional microwave ovens generally feed microwave energy into the cavity of the oven from a microwave source which feeds from only one direction, e.g. the top, bottom or side. While not wanting to be bound to any one theory, it is believed that the continuous grill elements of the present invention act like antennas, collecting and absorbing microwave energy. Thus, flat grills, i.e. substantially two dimensional grills, placed horizontally in the microwave oven cavity collect top and bottom fed microwave energy very efficiently. However, the angled grill of FIGS. 1 and 2 collects and absorbs microwave energy from a side fed microwave source more efficiently than do flat grills. The grills described below will generally be described as flat, but it is understood that at least a portion of the ends can be bent to improve the grill's reception of microwave energy.

Figure 2:
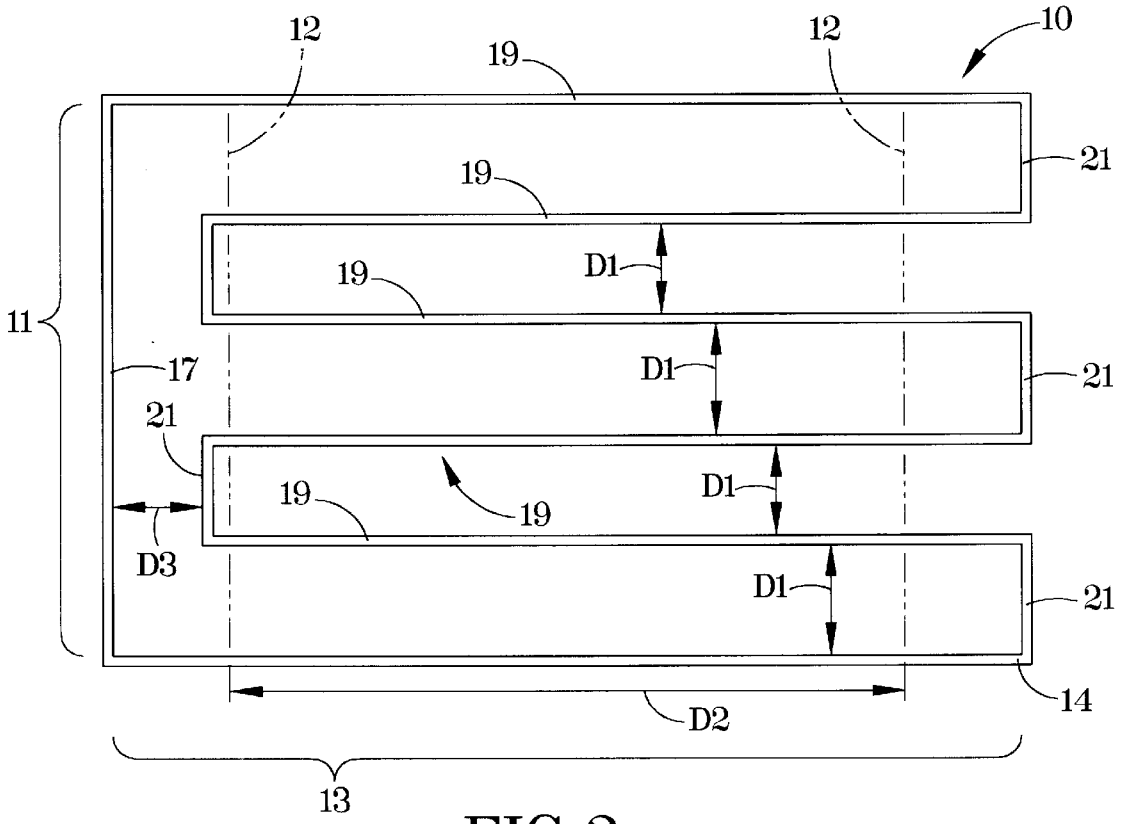
FIG. 2 is a schematic plan view of the continuous grill element of FIG. 1.

FIG. 2 is a schematic plan view of the microwave grill of FIG. 1. The lines 12, along which the continuous grill element 14 is bent, are transverse to grill element sides 13. Continuous grill element 10 is one preferred embodiment of the present invention and can be used to illustrate numerous aspects of the present invention. For example, grill element 14 is substantially continuous, i.e., grill 10 comprises one continuous element. Small breaks in the continuous element might result in arcing between the broken or disjointed pieces. Likewise, a large gap in the continuous grill element 14 might avoid arcing but would still leave two element ends which may produce localized overheating.

The continuous grill element 14 comprises a series of grill element segments 19 which, in the preferred embodiment of FIG. 2, are shown substantially parallel to one another. It is additionally preferred to have the spacing D1 between adjacent element segments 19 be substantially equal between all grill element segments 19. As can be appreciated, the distance D1 can vary but it is preferred that D1 remain within relatively narrow perimeters as discussed below.

The distance D1, which indicates spacing between adjacent element segments 19, should be approximately equal to an integer value of ⅛ of the microwave wave length associated with the microwave oven being used. The vast majority of conventional microwave ovens currently in use operate at 2450 MHz. Thus, a conventional microwave oven emits microwave energy at wave lengths, or λ, approximately within the range of from about 11.5 cm to about 14.0 cm. The microwave wave length, λ, is a critical perimeter when designing the microwave grills of the present invention. As discussed above, the grills of the present invention are believed to act as an antenna which receive the microwaves. Thus, the distances described herein as multiples of λ are intended to "tune" the grill to optimize the reception and collection of the microwave energy.

While not wanting to be limited to any one theory, it is believed that spacing the element segments 19 at distances, which are integer multiples of ⅛ λ, minimizes arcing between element segments 19. More specifically, it is preferred that D1 be equal to X*(⅛) wherein X is an integer from 1 to about 24. As can be appreciated integers encompass whole numbers i.e., 1, 2, 3 etc. It is preferable that distance D3, which is the distance between a grill element angular crossover 21 and the grill element loop completion segment 17, also be an integer multiples of ⅛ λ. As will be understood, it is preferred that D3 be an integer multiple of ⅛ λ, but D3 need not be equal to D1. Likewise, the entire length of the continuous elements of the present invention, for example, 14 and 114 of FIGS. 1, 2 and 3, should be an integer multiple of ½λ, i.e. X*(½λ).

As was discussed briefly above, most microwave ovens operate at 2450 MHz, this rating is typically an estimate and the microwave wavelengths generated by a conventional microwave oven will typically vary within a narrow band of microwave wavelengths. Thus, the descriptions of distances herein, which have been linked to integer multiples of a fraction of λ, are intended to encompass the entire band of λ's which normally occur in a conventional microwave oven. Thus, λ, as discussed above is intended to encompass wave lengths of from about 11.5 cm to about 14.0 cm. Thus, integer multiple of λ or integer multiples of a fraction of λ are intended to encompass any multiple that falls within the aforementioned range of λ. For example, if X=1, then X*(⅛ λ) is equal to the range of from about (⅛*11.5) to about (⅛*14.0), or from about 1.44 cm to about 1.74 cm.

Figure 3:
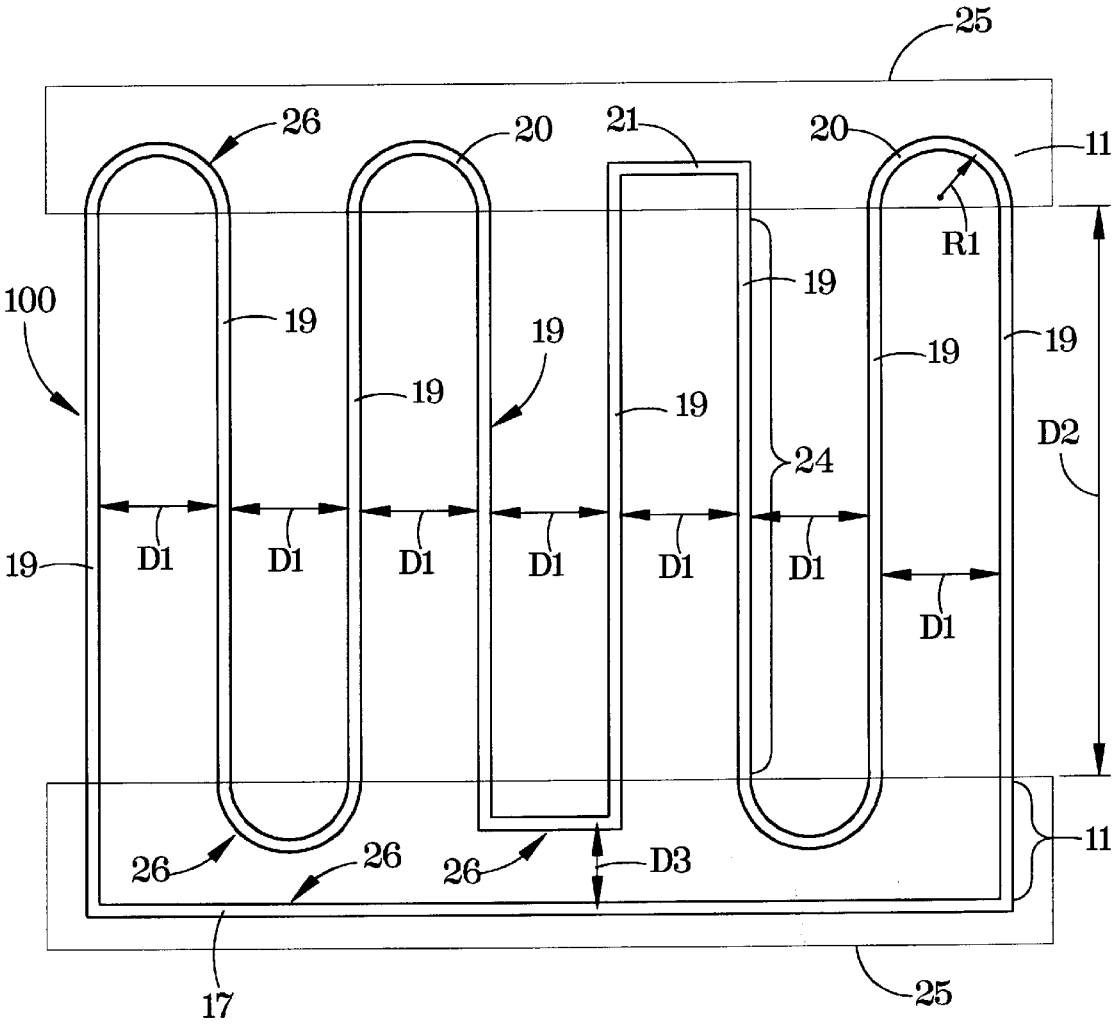
FIG. 3 is a schematic plan view of a grill of the present invention comprising a continuous grill element having insulated ends.

FIG. 3 is a schematic plan view of a microwave grill 100. The microwave grill comprises a continuous grill element 114 wherein insulation 25 has been provided on either end 11 of the continuous grill element 114. Insulation 25 is intended to be thermal insulation which can withstand sustained temperatures of above about 200° C., and which is generally transparent (i.e., neither absorbs nor reflects) microwave energy. Thus, the insulation material can be a variety of non-conductive materials, for example high density plastics, silicone rubbers, ceramics, wood and the like.

Distance D2 is the length of an exposed element segment, i.e., the portion of the continuous element segment between insulation 25. As can be seen in FIGS. 1 and 2, D2 is also the distance between bends in a non-insulated, bent embodiment of the present invention. To absorb the maximum amount of microwave energy, while minimizing the potential for arcing, it is preferred that D2 be an integer multiple of ½λ, i.e. X*(½λ). As was the case above, the integer X is intended to encompass whole numbers from 1 to about 24.

The insulated section 26 of grill element 114 should be continuous to avoid arcing and localized overheating within insulation 25. However, the configuration of the insulated section 26 is not necessarily critical. a rounded crossover 20 between grill element segments 19 is appropriate, as is angled crossover 21 between grill element segments 19. For the rounded crossovers 20 between grill elements 19 a radius R1 exists. As can be appreciated, R1 may be helpful in characterizing the continuous grill elements of the present invention, and certain radiuses may be easier to manufacturer than others, but the actual radius value itself is not critical to the functioning of the present invention. Likewise, the presence of insulation 25, while generally preferable, is not required.

As will be appreciated, if a microwave grill, e.g., 10 or 100, is neither bent nor insulated, the distance D2 will necessarily include the rounded and/or angular cross over sections, e.g., 20 and 21, and the grill element loop completion segment 17. As was discussed above, D2 is preferably an integer multiple of ½λ. Thus, the grill element segments 19 may need to be shortened or lengthened to accommodate for the added length of the grill element ends 11 if they are neither insulated or bent.

Figure 4:
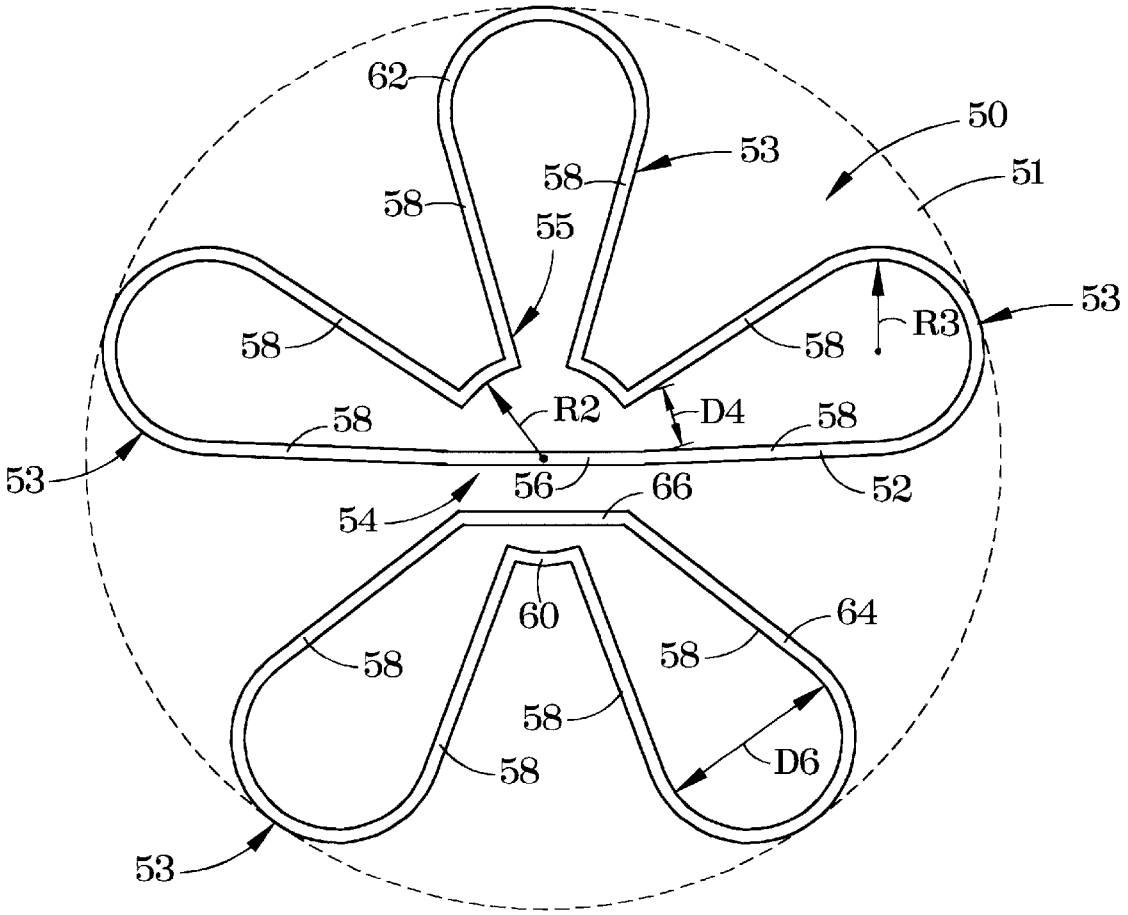
FIG. 4 is a schematic plan view of a grill of the present invention comprising a continuous grill element having an substantially round outer periphery.

FIG. 4 is a schematic plan view of an alternative embodiment of the present invention. FIGS. 1, 2 and 3 provide a generally rectangular grill which may not be optimal for all applications, for example, for cooking a round hamburger. Thus, FIG. 4 shows a round grill 50 which has an substantially round outer periphery 51. Round grill 50 comprises a plurality of petal shaped elements 53.

Petal shaped elements 53 are characterized in that distance D4, the distance between element segments 58 near the base 55 of petal shaped element 53, is less than distance D6, which is the distance between element segments 58 near crossover section 62. If D4 and D6 are approximately equal, i.e. the element segments 58 are substantially parallel, the grill will still function properly. However, the petal shaped design is intended to more uniformly space the element segments 58 around the substantially round outer periphery 51 of round grill 50. Crossover section 62 is shown as having a generally hemispherical geometry, although an angular crossover section, e.g. 21 of FIG. 3, will work as well. A series of petal shaped elements 53 are arranged around a round grill center 54. Round grill center 54 has a radius R2. Round grill center 54 is shown with two round grill center elements 56 and 66 which connect the petal shaped elements 53 in series. Continuous round grill element 52 forms an element with three petal shaped elements 53 and one round grill center element 56. Likewise, continuous round grill element 64 forms an element with two petal shaped elements 53 and one round grill center element 66. Other configurations are suitable for use herein, for example, each petal shaped element 53 can have a separate center element and a round grill, e.g. 50, can be constructed from individual petal shaped elements.

The number of petal shaped elements, and how many petal shaped elements are connected in series, are design considerations which can vary and will largely be determined by the size of round grill center 54, i.e., the length of radius R2. However, as was the case with the rectangular elements discussed above, the entire length of the continuous elements of the present invention, for example, 52 and 64, should be an integer multiple of ½λ, i.e. X*(½λ).

Petal shaped elements 53 are further connected in series by round grill interior crossover segments 60 which connect one petal shaped element to an adjacent petal shaped element 53 near their bases 55. The length of the interior crossover segment 60 should not vary from distance D4 by more than + or −50%. It is generally preferred that the length of the interior crossover segment 60 be approximately equal to D4, but, as can be appreciated by one of ordinary skill in the art, as distance D4 and interior crossover segment 60 increase in length, fewer petal shaped elements can be incorporated on round grill 50. Thus, generally, the distance D4 and the length of the interior crossover segments 60 should be minimized to allow for the maximum number of petal shaped elements 53 to be incorporated into round grill 50.

Figure 5:
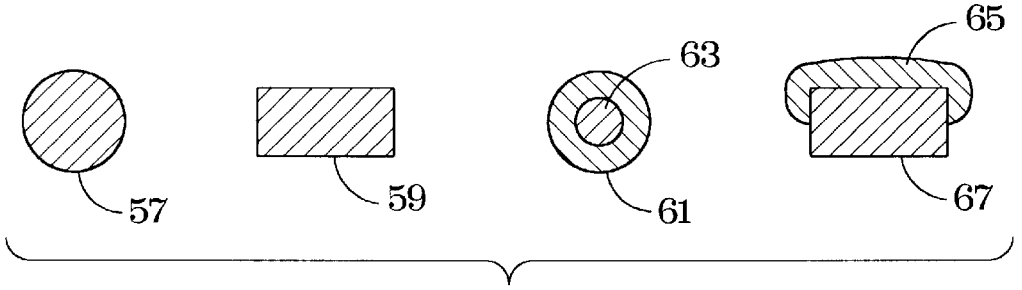
FIG. 5 is a schematic cross-sectional view of exemplary grill elements of the present invention.

FIG. 5 is a schematic of four cross-sectional views of preferred grill elements of the present invention. Conductive grill elements of the present invention can comprise a substantially round cross-section 57, or substantially rectangular cross-section 59 of one conductive material. The conductive material of the continuous grill elements described herein can be any appropriate microwave absorbing material for example, 440C stainless steel, 312 stainless steel, aluminum, iron, nickel, copper, chrome or mixtures thereof. However, composite continuous grill elements are also suitable for use with the grills described herein. For example, a round, non-conductive or conductive core 63 can be coated with a conductive or non-conductive coating 61. Both 63 and 61 can be conductive materials, e.g., a stainless steel rod coated with a layer of ferro-magnetic particles. Particles of conductive materials can be applied to a conductive or nonconductive core by any available means. For example, particles can be flame sprayed onto the core, or particles can be applied by incorporating the metallic particles in an organic binder such as paint and/or resin material. The organic binder/particle dispersion can be brushed or sprayed on the core, likewise, the element can be dipped in the dispersion to apply the coating.

Outer coating 61 can be a non-conductive coating on a conductive core 63, for example, a Teflon® coating can be applied to a conductive core 63. Necessarily, however, if 61 is a non-conductive coating it must be capable of withstanding the thermal energy generated by conductive core 63. Rectangular core 67, with coating 65 is another possible embodiment of the present invention, wherein core 67 and coating 65 can both be conductive elements, core 67 can be conductive while coating 65 can be a protective coating, non-stick coating or other non-conductive material, or core 67 and coating 65 can both be conductive materials. The four cross-sections schematically shown in FIG. 5 are intended to be exemplary and other cross-sectional configurations, for example, elements with three or more layers of conductive and non-conductive materials, are suitable for use with the grill elements described herein.

Figure 6:
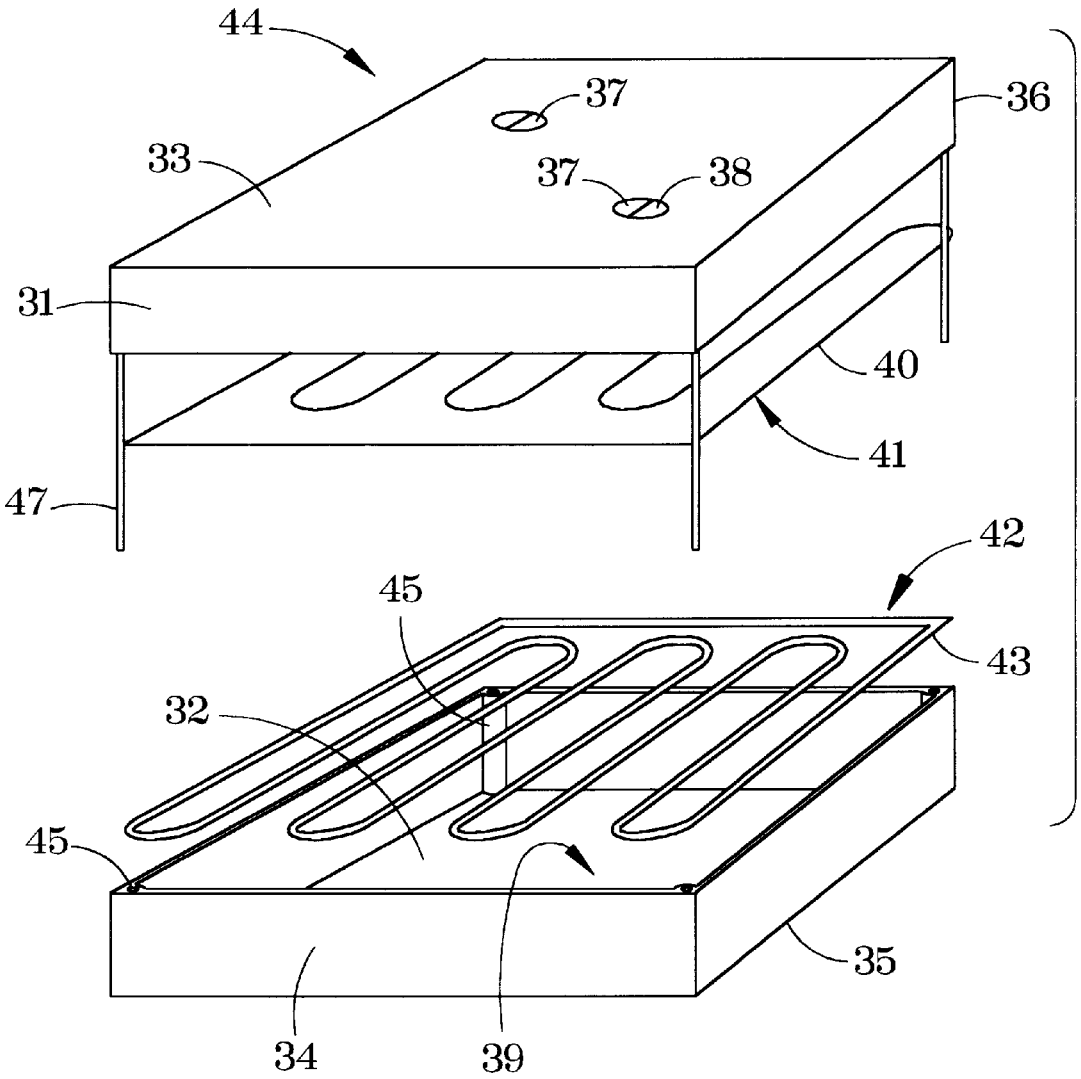
FIG. 6 is a schematic exploded view of one preferred microwave cooking apparatus according to the present invention.

FIG. 6 shows an exploded view of a microwave grilling apparatus 44 according to the present invention. The microwave grilling apparatus 44 comprises a grill 42, which comprises a continuous conductive grill element 43, and a tray 35 comprising tray walls 34 and a tray floor 32. The tray walls 34 and tray floor 32 form a tray interior 39 which is intended to contain or absorb liquids, for example the juices that drip off of a comestible, i.e. a food product, while it is being grilled. It is preferred, although not required, that grill element 43 be separated slightly from tray floor 32. Grill element 43 can be supported by tray walls 34, although other independent means of separating grill element 43 from tray floor 32 can be used. For example, if the ends of grill element 43 are insulated as shown in FIG. 3, the insulation can be made thick enough to separate grill element 43 from tray floor 32 by the desired distance. Grill element 43 can lay flat on tray floor 32, but it is generally preferred that there by a space between tray floor 32 and grill element 43 to allow liquid and/or air to flow beneath the surface of the comestible being grilled thereon.

While the grill elements described herein are suitable for use without a tray, trays are generally preferred to collect liquids, for example, juices which may seep out of the comestible being grilled, and/or to raise the grill element slightly to provide an area for air flow beneath the comestible. Thus, tray 35 is not necessary for the operation of the microwave grills described herein, although trays are generally preferred.

Leg receptacles 45 are shown adjacent the corners of tray 35. Leg receptacles 45 receive legs 47 to align and secure a cover 36 with tray 35. As can be appreciated, cover 36 is optional and may be used to envelope the comestible, for example, to retain the thermal energy generated during the grilling and microwave cooking process. Cover 36 comprises walls 31 and cover ceiling 33. Vent holes 38 with dampeners 37 are shown on the cover ceiling 33 wherein vent holes 38 can be opened and closed by dampeners 37 to relieve heat, steam and the like. A second grill 41 is shown which comprises a continuous conductive grill element 40 which can be used with or without cover 36. As can be appreciated, it is preferable to have grill elements, for example 40 and 43, on two sides of the comestible being grilled so that grilling is substantially uniform on the two sides without the need for turning the comestible during the grilling process. Thus, to grill in a microwave oven, at least one grill element, for example 43, is required, but two grill elements are preferred.

Although a generally rectangular configuration is schematically shown in FIG. 6 for microwave grilling apparatus 44, round grill apparatuses, and other geometric configurations are suitable for use with the microwave grills described herein. Likewise, while the legs 47 are shown as associated with cover 36 with the leg receptacles 45 being associated with tray 35, the number and placement of legs and their corresponding leg receptacles is a matter of choice and can be varied where appropriate. All materials in the microwave grilling apparatuses described herein, except for the grills, are preferably transparent to microwave energy. The trays, legs, dampeners, and other non-grill items, should preferably be made of plastic, ceramic, cardboard, and the like.

Figure 7:
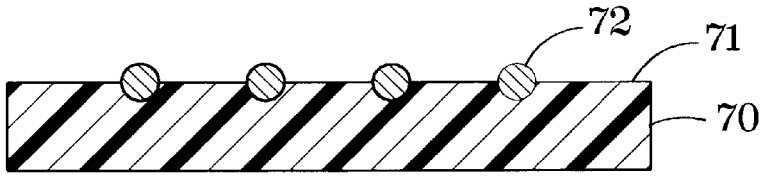
FIG. 7 is a cross-sectional view of a continuous grill element of the present invention imbedded in a non-conductive substrate.

FIG. 7 displays a schematic cross-section of a grill element 72 of the present invention which has been incorporated into a non-conductive surface 70. Non-conductive surface 70 can be, for example, a flat plate of plastic, fiber glass, ceramic, or other material which is generally transparent to microwave energy. Grill element 72, as can be appreciated, should be slightly raised above the surface 71 of non-conductive substrate 70 to increase the contact with the comestible being grilled. Non-conductive substrate 70, with grill element 72 incorporated therein, can be used as a microwave grill, or they can be used with a tray, for example, 35 and 36. Likewise, non-conductive substrate 70 can form either or both of the tray floor 32 or ceiling 33. The configuration of FIG. 7 is presented merely as an alternative embodiment of the present invention and it is understood that one of ordinary skill in the art could design a microwave grilling apparatus using one or more of the disclosed embodiments or modifications thereof.

The Detailed Description above will be better understood when read in conjunction with the following examples wherein the following examples utilized two, generally rectangular grills (e.g., 42 of FIG. 6), being approximately 6 cm (i.e., 4*(⅛ λ)) by 16.5 cm, wherein the element segment (e.g., D2, FIG. 2) lengths are approximately 12.7 cm (i.e., 2*(½λ)). The comestible, e.g. chicken breast, fish, etc., was placed between the two grills. For all of the examples, the grilling process was observed from a window in the door of the microwave oven to see if arcing or localized overheating of the grill element occurred. Arcing is detected by the presence of sparks, and localized overheating is characterized by "glowing" areas on the conductive element (although the view of certain areas of the grill on the bottom of the comestible were obscured by the comestible).

EXAMPLE 1

An eight ounce boneless/skinless chicken breast was grilled using the grill described above. The continuous grill element was made of SS 312 with a cross sectional area of about 0.01 $cm^2$. A Sharp (Side-Fed-Oven) microwave oven, approximately 900 watts of power, operating at approximately 2450 MHz, oven was used to grill the chicken breast. The chicken breast was fully cooked with grill marks on both sides within four minutes on the high power setting. No arcing or localized over heating of the element was observed.

EXAMPLE 2

A five ounce boneless, skinless chicken breast was cooked using the grill described above. The continuous grill element was made of SS 312 with a cross sectional area of about 0.006 $cm^2$. A Sharp (Side-Fed-Oven) microwave oven, approximately 900 watts of power, operating at approximately 2450 MHz, oven was used to grill the chicken breast. The chicken breast was fully cooked with grill marks on both sides within three minutes on the high power setting. No arcing or localized over heating of the element was observed. The grill marks on the chicken breast surfaces were more intense as compared to the chicken breast of Example 1.

EXAMPLE 3

An eight ounce fish (halibut) steak was cooked using the grill described above. The continuous grill element was made of SS 312 with a cross sectional area of about 0.006 $cm^2$. An Amana (Top-Fed-Oven) microwave oven, approximately 700 watts of power, operating at approximately 2450 MHz, oven was used to grill the fish steak. The fish steak was fully cooked with grill marks on both sides within three minutes on the high power setting. No arcing or localized over heating of the element was observed.

EXAMPLE 4

Four hot dogs were cooked using the grill described above. The continuous grill element was made of SS 312 with a cross sectional area of about 0.006 $cm^2$. An Amana (Top-Fed-Oven) microwave oven, approximately 700 watts of power, operating at approximately 2450 MHz, was used to was used to cook the hot dogs in 1 minutes and 30 seconds. The hot dogs were fully cooked with grill marks on both sides. No arcing or localized over heating of the element was observed.

Having shown and described the preferred embodiments of the present invention, further adaptation of the microwave grill and microwave grilling apparatuses described herein can be accomplished by appropriate modifications by one of ordinary skill in the art without departing from the scope of the present invention. A number of alternatives and modifications have been described herein and others will be apparent to those skilled in the art. For example, the grills, which have been shown in generally rectangular and round configurations, can be designed in other geometric configurations, for example, triangular, elliptical and the like. Additionally, although certain preferred conductive and non-conductive materials have been disclosed as appropriate materials of construction for the grill element and microwave grilling apparatus described herein, other material may be equally suitable for use with the present invention. Accordingly, the scope of the present invention should be considered in terms of the following claims and is understood not to be limited to the details and materials shown and described in the specification.

I claim:

1. A microwave grilling apparatus comprising:

a first grill comprising:

a continuous conductive grill element loop which is shaped into:

at least four substantially parallel linear segments;

a first crossover segment serially connecting the first and second linear segments and extending between the first linear segment and the second linear segment;

a second crossover segment serially connecting the second and third linear segments and extending between the second linear segment and the third linear segment;

a third crossover segment serially connecting the third and fourth linear segments and extending between the third linear segment and the fourth linear segment; and a loop completion segment serially connecting the first linear segment with the last linear segment, wherein substantially the entire loop is capable of collecting microwave energy; and a pair of insulators provided at oppositely disposed ends of the linear segments;

wherein the linear segments of the grill element loop have a cross-sectional surface area of between about $5\times10^{-3}$ $cm^2$ to about 0.1 $cm^2$; and wherein the total length of the continuous grill element loop is of about $X*(\frac{1}{2})\lambda$, each of the linear segments individually has a length of about $Y*(\frac{1}{2})\lambda$ between the insulators, and adjacent linear segments are spaced apart by a distance of about $Z*(\frac{1}{8}\lambda)$, wherein X, Y, and Z are integers from 1 to about 24 and $\lambda$ is a wavelength of microwave energy and is from about 11.5 cm to about 14.0 cm.

2. A microwave grilling apparatus according to claim 1, further comprising a tray wherein the first grill is at least partially supported by the tray.

3. A microwave grilling apparatus according to claim 2, further comprising:

a second grill comprising:

a continuous conductive grill element loop having:

at least four substantially parallel linear segments;

a first crossover segment serially connecting the first and second linear segments and extending between the first linear segment and the second linear segment;

a second crossover segment serially connecting the second and third linear segments and extending between the second linear segment and the third linear segment;

a third crossover segment serially connecting the third and fourth linear segments and extending between the third linear segment and the fourth linear segment; and a loop completion segment serially connecting the first linear segment with the last linear segment, wherein substantially the entire loop is capable of collecting microwave energy; and a pair of insulators provided at oppositely disposed ends of the linear segments;

wherein the linear segments of the second grill has a cross-sectional surface area of between about $5\times10^{-3}$ $cm^2$ to about 0.1 $cm^2$;

wherein the total length of the continuous loop of the second grill of about $X*(\frac{1}{2})\lambda$, each of the linear segments of the second grill individually has a length of about $Y*(\frac{1}{2})\lambda$ between the pair of insulators, and adjacent linear segments of the second grill are spaced apart by a distance of about $Z*(\frac{1}{8}\lambda)$, wherein X, Y, and Z are integers from 1 to about 24 and $\lambda$ is a wavelength of microwave energy and is from about 11.5 cm to about 14.0 cm.

4. A microwave grilling apparatus according to claim 3, further comprising a cover wherein the second grill is substantially housed within the cover.

5. The microwave grilling apparatus of claim 4, wherein the cover comprises one or more adjustable vent holes and the tray can retain a liquid.

6. A microwave grilling apparatus according to claim 4, further comprising a plurality of legs extending between the tray and the cover and a plurality of corresponding leg receptacles.

7. A microwave grilling apparatus according to claim 4, wherein a comestible may be positioned between the second grill and the first grill.

8. A microwave grilling apparatus according to claim 2, wherein the first grill is at least partially separated from the tray.

9. A microwave grilling apparatus according to claim 1, wherein the first grill further comprises opposing ends which are bent at an angle of between about 20° and about 70°.

10. A microwave grilling apparatus according to claim 1, wherein the conductive material of the continuous grill element loop comprises 440C stainless steel, 312 stainless steel, aluminum, iron, nickel, copper, chrome or mixtures thereof.

11. A microwave grilling apparatus according to claim 1, wherein the continuous conductive grill element loop further comprises a non-conductive core.

12. A microwave grilling apparatus according to claim 1, wherein the continuous conductive grill element loop comprises a non-conductive core with at least a portion of the core being coated with a conductive material.

13. A microwave grilling apparatus according to claim 12, wherein the conductive material is applied to the non-conductive core by flame spraying or by applying to the non-conductive core a dispersion of conductive particles in an organic binder.

14. A microwave grilling apparatus according to claim 1, wherein at least a portion of the continuous conductive grill element loop is at least partially coated with a non-conductive material.

15. A microwave grilling apparatus comprising:

a first grill comprising a continuous conductive loop which is shaped into a plurality of spaced substantially linear segments, at least a portion of the linear segments being non-insulated;

at least one of the linear segments of the loop having a cross-sectional surface area of between about $5\times10^{-3}$ $cm^2$ to about 0.1 $cm^2$;

wherein the total length of the loop is of about $X*(\frac{1}{2}\lambda)$, the non-insulated portions of the linear segments have a length of about $Y*(\frac{1}{2}\lambda)$, and adjacent linear segments are spaced apart by a distance of about $Z*(\frac{1}{8}\lambda)$, wherein X, Y, and Z are integers from 1 to about 24 and $\lambda$ is a wavelength of microwave energy and is from about 11.5 cm to about 14.0 cm.

16. The microwave grilling apparatus of claim 15, further comprising:

a tray wherein the first grill is at least partially supported by the tray;

a second grill;

a cover, wherein the second grill is substantially housed within the cover.

17. A microwave grilling apparatus according to claim 16, further comprising a plurality of legs extending between the tray and cover and a plurality of corresponding leg receptacles.

18. A microwave grilling apparatus according to claim 16, wherein a comestible may be positioned between the second grill and the first grill.

19. A microwave grilling apparatus according to claim 15, wherein at least a portion of the continuous conductive loop is thermally insulated.

20. A microwave grilling apparatus according to claim 15, wherein opposite sides of the grill are bent at an angle of between about 20° and about 70°.

21. A microwave grilling apparatus according to claim 15, wherein the continuous conductive loop comprises 440C stainless steel, 312 stainless steel, aluminum, iron, nickel, copper, chrome or mixtures thereof.

22. A microwave grilling apparatus according to claim 15, wherein the linear segments are substantially parallel.

23. A microwave grilling apparatus comprising:

a first grill comprising:

at least one continuous conductive loop being shaped into a plurality of spaced and serially connected petal shaped elements;

each of the petal shaped elements comprising two spaced substantially linear segments and a cross over element section connecting the two linear segments;

wherein at least one of the linear segments of the continuous conductive loop has a cross-sectional area of from about $5\times10^{-3}$ $cm^2$ to about 0.1 $cm^2$; and wherein the total length of the loop is of about X*(½λ), each of the petal shaped element segments has a length of about Y*(½λ), and adjacent petal shaped elements are spaced apart by a distance of about Z*(⅛λ), wherein X, Y, and Z are integers from 1 to about 24 and λ is a wavelength of microwave energy and is from about 11.5 cm to about 14.0 cm, and wherein substantially the entire loop is capable of collecting microwave energy.

24. A microwave grilling apparatus, comprising:

a continuous conductive loop comprising:

two substantially linear segments; and a crossover segment connecting the two linear segments;

wherein the total length of the loop is of about X*(½λ), and the linear segments are spaced apart by a distance of about Z*(⅛λ), wherein X and Z are integers from 1 to about 24 and λ is a wavelength of microwave energy, and wherein substantially the entire loop is capable of collecting microwave energy.

25. The apparatus as recited in claim 24, further comprising:

a tray having a bottom and a support, the loop resting upon the support and above the tray bottom; and a cover housing a microwave grilling element.

26. The apparatus as recited in claim 24, wherein the loop is substantially rectangular in shape.

27. The apparatus as recited in claim 26, further comprising:

an insulating material provided on one side of the rectangular loop.

28. The apparatus as recited in claim 24, wherein the wavelength is from about 11.5 cm to about 14.0 cm.

29. A microwave grilling apparatus comprising:

a continuous conductive loop having:

at least two spaced linear segments;

wherein substantially the entire loop is capable of collecting microwave energy without use of designated antenna portions, the total length of the continuous loop is of about X*(½)λ, and the spaced linear segments are spaced apart by a distance of about Z*(⅛λ), and wherein X and Z are integers from 1 to about 24 and λ is a wavelength of microwave energy which is in the range of from about 11.5 cm to about 14.0 cm.

30. The apparatus as recited in claim 29, further comprising:

a pair of insulators provided at opposing ends of the loop, wherein each of the linear segments has a length of about Y*(½)λ between the insulators, wherein Y is an integer from 1 to about 24 and λ is a wavelength of microwave energy which is in the range of from about 11.5 cm to about 14.0 cm.

31. The apparatus as recited in claim 30, wherein the linear segments have a cross-sectional surface area of between about $5\times10^{-3}$ $cm^2$ to about 0.1 $cm^2$.

32. A microwave grilling apparatus, comprising:

a continuous conductive loop comprising at least four spaced linear segments and a plurality of crossover segments serially connecting the four spaced linear segments, wherein the linear segments are subsubstantially parallel, and wherein substantially the entire loop is capable of collecting microwave energy without use of designated antenna portions.

* * * * *